United States Patent [19]

Hoge

[11] Patent Number: 4,651,625

[45] Date of Patent: Mar. 24, 1987

[54] PNEUMATIC CONTROL ASSEMBLY FOR A PNEUMATIC CYLINDER

[75] Inventor: Ned W. Hoge, Akron, Ohio

[73] Assignee: United Controls, Inc., Akron, Ohio

[21] Appl. No.: 612,589

[22] Filed: May 21, 1984

[51] Int. Cl.[4] ..... F15B 11/08

[52] U.S. Cl. ..... 91/461; 91/463; 91/465

[58] Field of Search ..... 91/461, 459, 462, 463, 91/464, 465

[56] References Cited

U.S. PATENT DOCUMENTS

| | | | |
|---|---|---|---|
| 3,004,528 | 10/1961 | Logan, Jr. et al. | 91/459 |
| 3,233,523 | 2/1966 | Passaggio | 91/459 |

FOREIGN PATENT DOCUMENTS

| | | | |
|---|---|---|---|
| 3041339 | 6/1982 | Fed. Rep. of Germany | 91/462 |
| 0003987 | 1/1977 | Japan | 91/459 |

*Primary Examiner*—Edward K. Look

*Attorney, Agent, or Firm*—Reising, Ethington, Barnard, Perry & Milton

[57] ABSTRACT

A pneumatic control assembly for a pneumatic cylinder having cylinder ports at the opposite ends thereof wherein the control assembly includes a valve body clamped directly to the pneumatic cylinder by a stud extending completely through the valve body and threadedly engaging the bore in the cylinder to provide the only means for maintaining the valve body attached to the pneumatic cylinder. An identical stud extends through an adapter to engage the other port in the cylinder and a pilot body is connected to the valve body by screws and includes electrically actuated solenoids for conducting pilot pressure to the valve body for allowing the full pressure to enter and exhaust from the respective ports in the cylinder to move the piston therein back and forth. The valve body has two coupling ports extending completely therethrough for receiving the mounting stud in either position to vary the position at which the valve body may be attached to the cylinder with a sealing plug disposed in the other coupling port whereby the entire assembly may be attached to various different cylinders of different lengths with only the stud members extending into threaded engagement with the cylinder ports.

20 Claims, 10 Drawing

PNEUMATIC CONTROL ASSEMBLY FOR A PNEUMATIC CYLINDER

TECHNICAL FIELD

This invention relates to pneumatic cylinders which produce mechanical push-pull forces when compressed air is directed against one side of a piston within a cylinder while air from the opposite side of the piston is allowed to exhaust. Specifically, the invention relates to a pneumatic control assembly which may be attached to the penumatic cylinder for controlling the inlet of compressed air to one side of the piston and the exhaust of the air from the opposite side of the piston by electrically actuated pilot valves.

BACKGROUND ART

The charging and exhausting of alternate sides of the piston in an air cylinder is accomplished by an air control assembly connected to the cylinder ports. Some of the disadvantages of cylinder-mounted control assemblies are that they must be factory installed because they are specially adapted for mounting only on a particular air cylinder, or when adapted to be mounted in the aftermarket require modification to the cylinders in order to attach the control assemblies, for example, by the drilling and tapping of bolt holes. In some instances the control assemblies cannot be mounted on air cylinders having a standard rear clevis mount centrally of the cylinder because they occupy that space. Many control assemblies when mounted on a cylinder extend over the edges or outward extremities and invade the cylinder mounting surfaces. Many control assemblies are limited and cannot accommodate an air cylinder having a piston rod travel below a certain minimum distance such as two inches.

STATEMENT OF INVENTION AND ADVANTAGES

A pneumatic control assembly for a pneumatic cylinder having a piston movable therein between first and second positions and a rod extending from the piston exteriorly of the cylinder with the cylinder including first and second cylinder ports therein for communication of fluid to and from opposite sides of the piston for moving the piston and rod between the first and second positions. The assembly comprises a valve body means for directing fluid from a source to the cylinder ports and for directing fluid from the cylinder ports to an exhaust environment. A pilot body means is mountable on the valve body means for piloting the operation of the valve body means in response to control signals. The valve body means has a first coupling port for communicating with the first cylinder port and a transfer port for communicating with the second cylinder port and transfer means establishes fluid communication between the transfer port in the valve body means and the second cylinder port. The valve body means has a first face for engaging the pneumatic cylinder about the first cylinder port therein and a second face oppositely disposed and spaced from the first face for flush engagement with the pilot body means. The assembly is characterized by the first coupling port extending through the valve body means between the first and second faces thereof and by including mounting stud means for extending through the first coupling port and connecting to the first cylinder port for providing the sole mounting force of the valve body means to the pneumatic cylinder and for establishing sealed fluid communication between the valve body means and the first cylinder port while allowing the pilot body means to be flush mounted against the second face and over the mounting stud means.

The subject invention provides the advantages over the prior art assemblies of being attachable directly and easily to all standard commercially available air cylinders and most nonstandard cylinders and can be installed in the field in a matter of minutes by requiring only two attaching points, both of which are to the ports in the clyinder, thereby eliminating the requirement for modification of the cylinders in order to be attached thereto. Additionally, all of the components necessary for the installation or the attachment of the control assembly to an air cylinder are simply provided and may be easily assembled. The control assembly may be attached to all mounting types of cylinders, including cylinders having rear-clevis mounts, as the control assembly does not invade the cylinder mounting surfaces nor the end areas of the cylinder. Additionally, the control assembly has multiple selection mounting positions so that it may accommodate air cylinders having very minimum piston travel as, for example, less than two inches.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
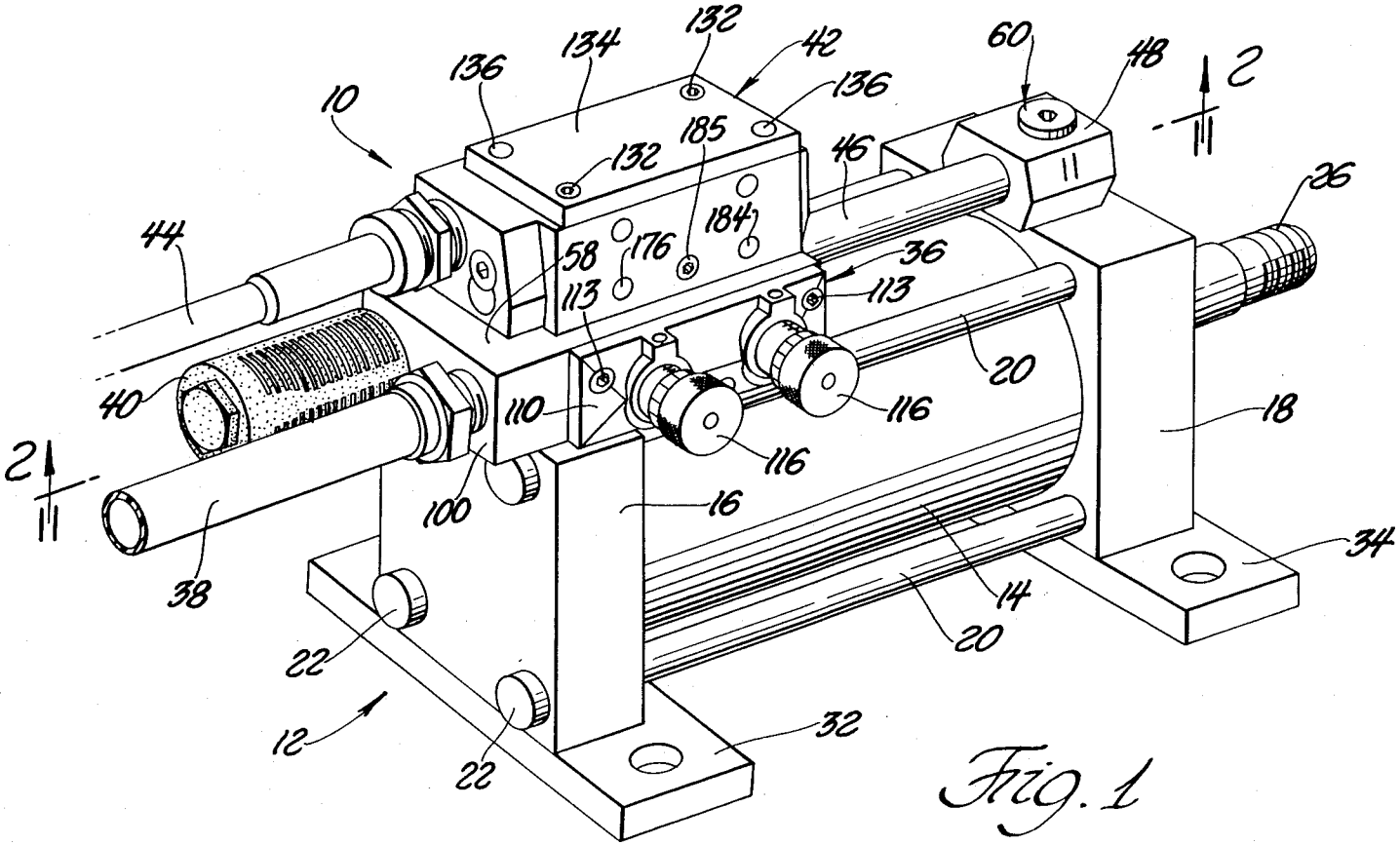
FIG. 1 is perspective view of a preferred embodiment of the pneumatic control assembly of the subject invention attached to a pneumatic cylinder.
Figure 2:
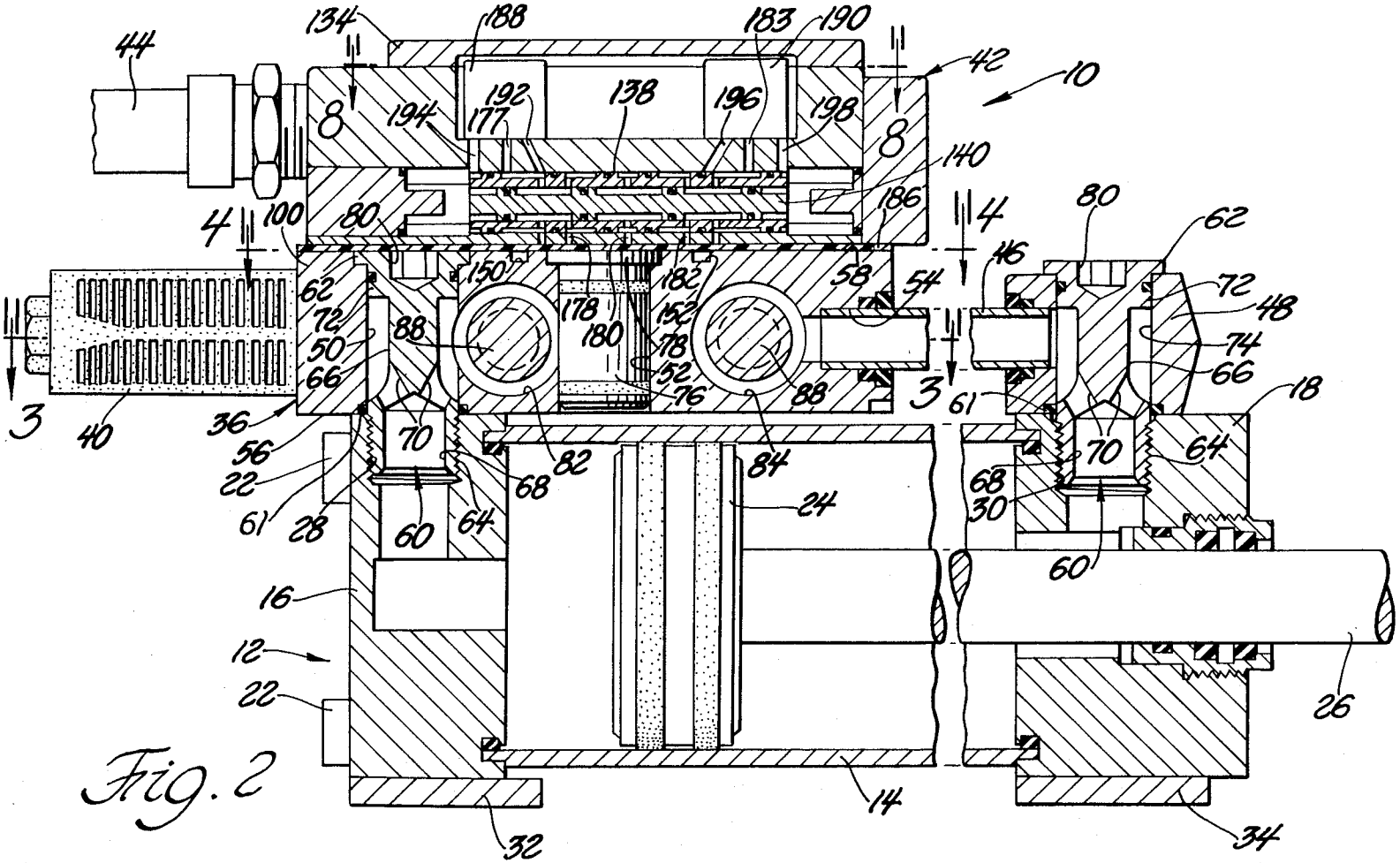
FIG. 2 is a cross-sectional view taken substantially along line 2—2 of FIG. 1.

A pneumatic control assembly attached to a pneumatic cylinder is shown generally in FIGS. 1 and 2. The pneumatic control assembly is generally shown at 10 and the air or pneumatic cylinder is generally shown at 12.

The pneumatic cylinder 12 is of a type generally well-known in the art comprising a tube 14 clamped between a pair of end members or blocks 16 and 18 by a plurality of tie rods 20. The tie rods 20 have heads 22 at one end and threadedly engage the block 18 at the other end. A piston 24 is reciprocally supported within the tubular cylinder 14 and has a piston rod 26 attached thereto and extending exteriorly of the cylinder. The pneumatic cylinder includes first and second threaded cylinder ports 28 and 30 in the end blocks 16 and 18, respecitvely. In addition, the pneumatic cylinder assembly 12 includes the support plates 32 and 34 which are secured by welding or fasteners to the bottom of the blocks 16 and 18, respectively, and have holes therein for mounting the pneumatic cylinder to a support structure. The cylinder ports 28 and 30 establish fluid communication to and from opposite sides of the piston 24 for moving the piston 24 and the rod 26 between first and second positions at opposite ends of the cylinder.

The control assembly 10 includes a valve body means generally indicated at 36 for directing fluid from a source to the cylinder ports 28 and 30 and for directing fluid from the cylinder ports 28 and 30 to an exhaust environment. The valve body 36 has attached thereto a high-pressure conduit or hose 38 which serves as the source of high-pressure air. The valve body 36 also has an exhaust which exhausts air through a muffler 40.

The control assembly 10 also includes a pilot body means generally indicated at 42 mountable on the valve body means 36 for piloting the operation of the valve body means in response to control signals. The control signals are directed to the pilot body means 42 through an electrical conduit 44 which provides electrical signals to the pilot body means 42.

The control assembly 10 also includes a transfer means comprising a tube 46 and an adapter 48 for establishing fluid communication between the valve body 36 and the second cylinder port 30.

The valve body means 36 has first and second coupling ports 50 and 52, respectively. Either coupling port 50, 52 may communicate with the first cylinder port 28. The valve body means 36 also includes a transfer port 54 for communicating with the second cylinder port 30 through the tube 46 and the adapter 48.

The valve body means 36 has a first or lower face 56 for engaging the block 16 of the pneumatic cylinder 12 about the first cylinder port 28 therein. The valve body means 36 also includes a second or upper face 58 for flush engagement with the bottom surface of the pilot body means 42.

The coupling ports 50 and 52 extend completely through the valve body 36 between the first and second faces 56 and 58 thereof.

The assembly 10 also includes mounting stud means comprising integral stud members each generally indicated at 60. One of the stud members 60 extends through the coupling port 50 and is threadedly connected to the first cylinder port 28 for providing the sole mounting force of the vavle body means 36 to the pneumatic cylinder 12. The stud member 60 in the coupling port 50 also establishes sealed communication between the valve body means 36 and the cylinder port 28 while allowing the pilot body means 42 to be flush mounted against the upper face 58 and over the integral mounting stud 60. Seals 61 are disposed in recesses in the body means 42 about ports 28 and 30 to seal with the upper surfaces of the blocks 16 and 18.

Each integral mounting stud member 60 has a circular or annular flange 62 at the first or top end thereof and threads 64 at the second or bottom end thereof for threadedly engaging the cylinder ports 28 and 30. The first stud member 60 clamps the valve body means 36 between the flange 62 thereof and the cylinder port 28 as the mounting stud 60 is placed in tension between the flange 62 thereof and the threads 64 at the opposite end thereof. In a similar fashion the other stud member 60 is placed in tension between its flange 62 engaging the top of the adapter member 48 and its threads 64 which threadedly engage the second cylinder port 30. Each stud member 60 includes a central shank portion of a lesser diameter than the diameter of the threaded portion 64 and positioned between the threads 64 and the flange 62. Each stud member 60 also includes a pocket 68 in the lower end thereof and interiorly of the threaded portion 64. Also included are conically or divergently extending passages 70 interconnecting the pocket 68 and the exterior of the shank portion 66. In addition, each stud member 60 includes a cylindrical sealing portion 72 of smaller diameter than the flange 62 and of a larger diameter than the shank portion 66 and having an annular seal therein and extending between the flange 62 and the shank portion 66 for sealing engagement with the interior surface of one of the coupling ports 50 or 52 or the coupling passageway 74 extending completely through the adapter member 48. The valve body means 36 has an annular recess in the upper face 58 thereof extending about each of the coupling ports 50 and 52 for receiving the flange 62 of the stud member 60 so that the stud member 60 in the coupling port is prevented from interfering with the flush mounting of the pilot body means 42 against the second or upper surface 58 of the valve body means 36.

A sealing plug means or member 76 is disposed in the second coupling port 52 and includes a flange 78 at the upper end thereof with a cylindrical sealing surface having seals therein for engaging the interior surface of the coupling port 52 extending below the flange 78 thereof to prevent fluid flow through the coupling port 52. The valve body means 36 may be attached to the pneumatic cylinder 12 at either of two longitudinal positions spaced apart from one another by the distance between the first and second coupling ports 50 and 52 as the stud member 60 may be disposed in the coupling port 52 and the sealing plug 76 disposed in the coupling port 50 so that the valve body means 36 would be moved to the left as viewed in FIGS. 1 and 2. Such allows for great versatility in mounting the control assembly to a pneumatic cylinder so as to accommodate strokes of various different lengths, including very short strokes.

Each stud member 60 has a tool-receiving socket 80 in the end thereof for receiving a tool such as an Allen wrench for threadedly tightening the stud members 60.

Both stud members 60 are identical and the stud member 60 disposed in the coupling passage 74 of the adapter member 48 has its flange 62 engaging the top of the adapter member 48 for clamping the adapter member 48 into sealing engagement with the top of the block 18 defining the second cylinder port 30. The tube 46 is in fluid communication with the coupling passage 66. The tube 46 has its ends in sealing engagement respectively with the valve body means 36 and the adapter 48. The tube 46 may be cut to a length as required by the distance between the cylinder ports 28 and 30.

Figure 3:
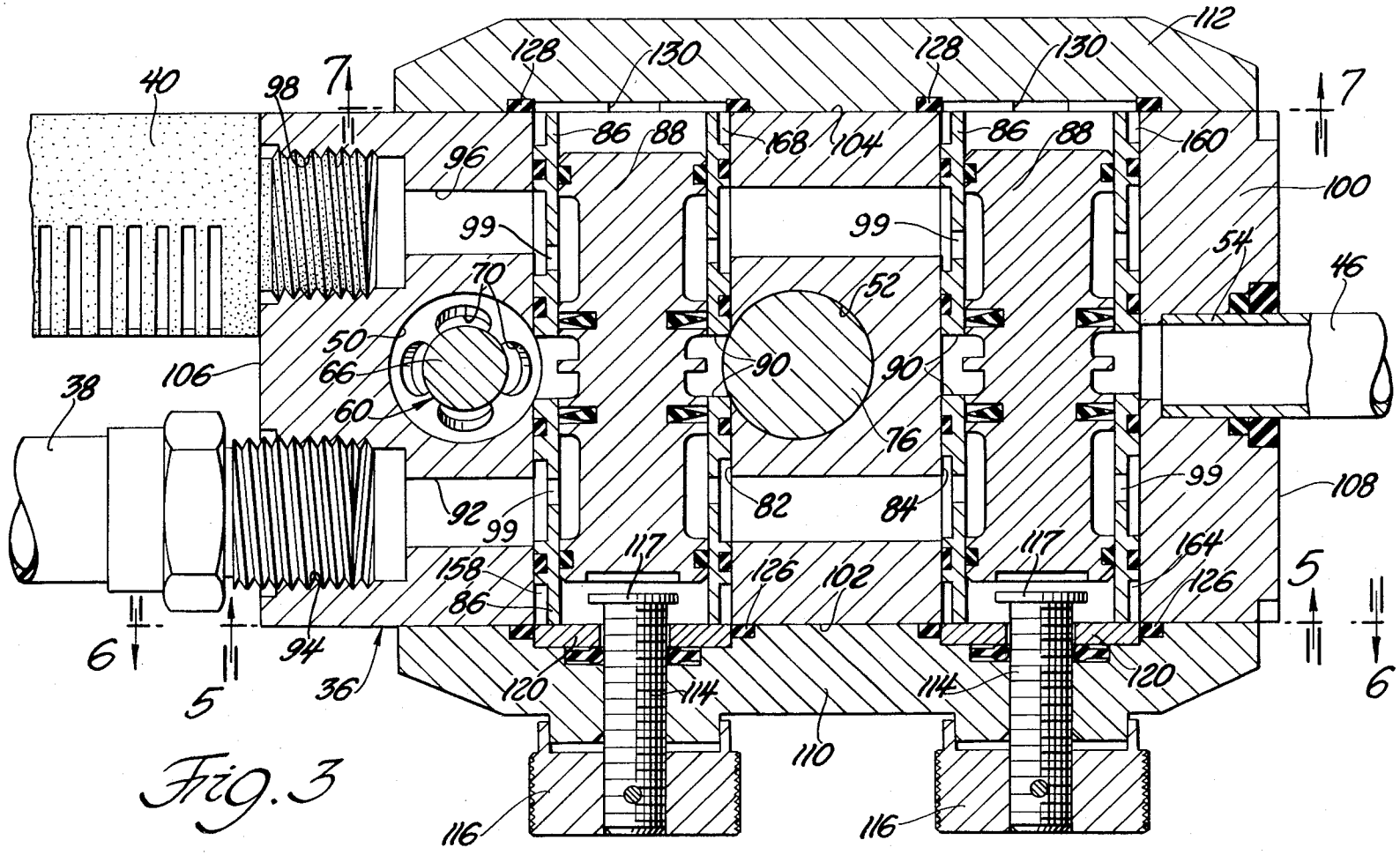
FIG. 3 is a cross-sectional view taken substantially along line 3—3 of FIG. 2.
Figure 4:
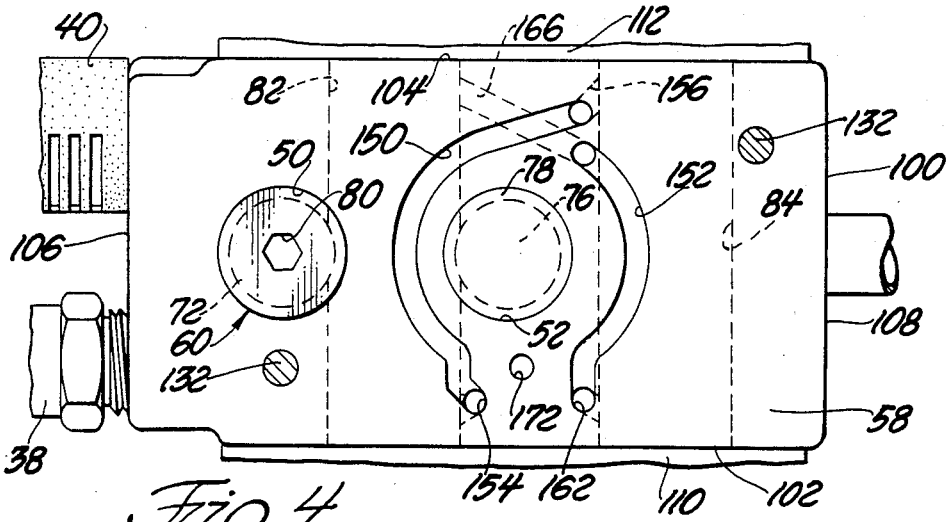
FIG. 4 is a cross-sectional view taken substantially along line 4—4 of FIG. 2.
Figure 5:
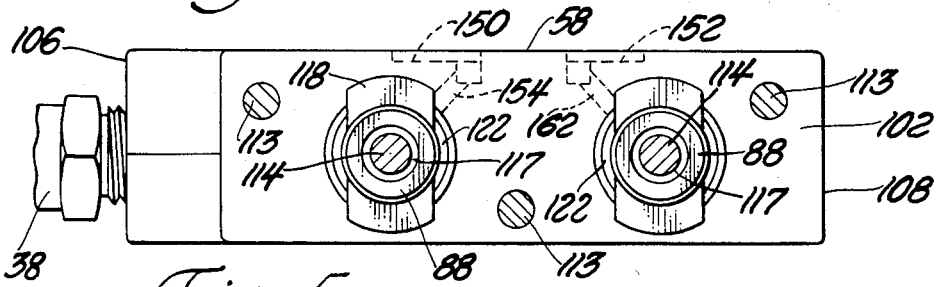
FIG. 5 is a cross-sectional view taken substantially along line 5—5 of FIG. 3.
Figure 6:
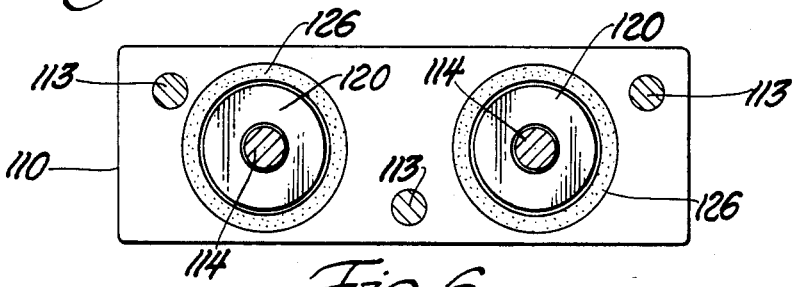
FIG. 6 is a cross-sectional view taken substantially along line 6—6 FIG. 3.
Figure 7:
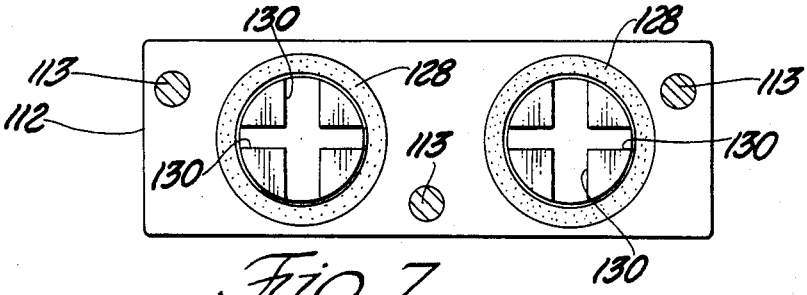
FIG. 7 is a cross-sectional view taken substantially along line 7—7 of FIG. 3.
Figure 8:
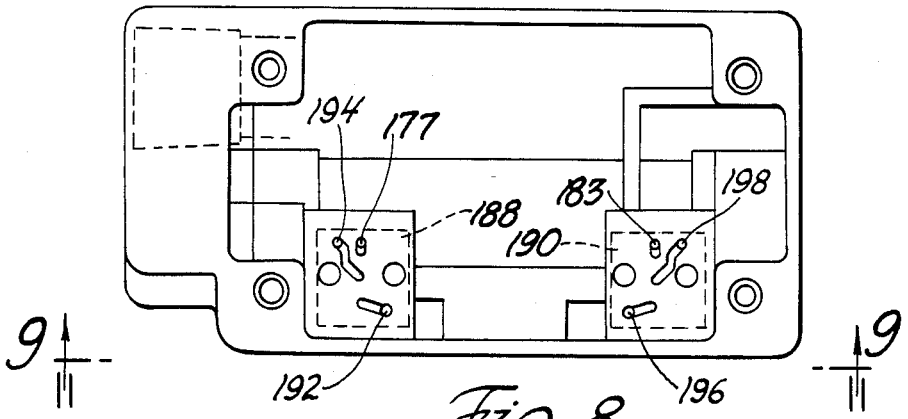
FIG. 8 is a cross-sectional view taken substantially along line 8—8 of FIG. 2.
Figure 9:
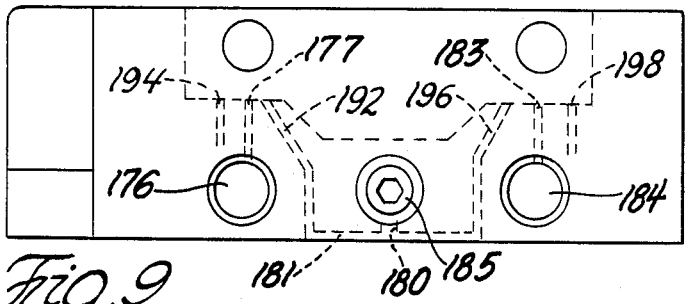
FIG. 9 is a side view taken substantially along line 9—9 of FIG. 8.

The valve body means 36 includes first and second spool valve bores 82 and 84 extending transversely to the coupling ports 50 and 52. The first and second coupling ports 50 and 52 extend through the valve body means 36 on opposite sides of the first spool valve bore 82. Each of the coupling ports 50 and 52 is in fluid communication with the first spool valve bore 82. The spool valve bores 82 and 84 are cylindrical as are the coupling ports 50 and 52 which coupling ports 50 and 52 each extend into and through the first spool bore 82 to etablish fluid communication therewith. Cylindrical sleeve means comprising identical sleeve members 86 are disposed in the spool bores 82 and 84 for slidably supporting identical spool valves 88. The sleeve members 86 in each spool bore 82 and 84 define an annular void to present an annular opening between the inward ends 90 of the sleeve members 86 in each spool bore which opening is disposed between each of the coupling ports 50 and 52 and the first spool bore 82 for spacing the circumferential extremity of the spool valve 88 therein from the circumference of the coupling ports 50 and 52 which is best illustrated in FIG. 3. The spool bores 82 and 84 are parallel with one another and the transfer port 54 communicates with the void or the opening between the inward and opposing ends 90 of the sleeve members 86 in the second spool bore 84.

The valve body means 36 includes an inlet passage 92 extending along a first axis from a threaded entry port 94 through the first spool valve bore 82 and onto the second spool valve bore 84. In addition, an exhaust passage 96 extends along a second axis from a threaded exhaust port 98 through the first spool valve bore 82 and onto the second spool valve bore 84. The first and second passages 92 and 96 are parallel to one another and are positioned on opposite sides of the coupling ports 50 and 52. In other words, the coupling ports 50 and 52 are disposed between the passages 92 and 96. Each of the sleeve 86 includes diametrically opposed slots 99 facing the passages 92 and 96.

The valve body means 36 comprises a rectangular metal block 100 presenting the first and second or bottom and top faces 56 and 58 extending between first and second sides 102 and 104. The block 100 also includes first and second parallel ends 106 and 108 with the inlet passage 92 and the exhaust passage 96 extending into the first end 106 and the transfer passage port 54 extending into the second end 108. The spool valve bores 82 and 84 extend through the block 100 between the first and second sides 102 and 104 and the assembly includes first and second side caps 110 and 112 in sealing engagement with the sides 102 and 104 to close the opposite ends of the spool valve bores 82 and 84. The caps 110 and 112 are secured to opposite sides 102 and 104 of the block 100 by Allen-fastening screws or bolts 113.

The valve body means also includes adjustable stop means comprising the threaded members 114 which respectively threadedly engage the cap member 110 and have knobs 116 attached to the outward ends thereof. Each of the knobs 116 may be rotated to turn the threaded members 114 as they threadedly engage the caps 110 for axial displacement to limit the amount of movement of the spool valve members 88 to control the rate at which fluid is exhausted through the exhaust port 98 from the opposite sides of the piston 24.

Flat heads 117 are disposed at the inside ends of the threaded screw members 114 for abutting the ends of the valve spools 88 to limit the movement of valve spools 88 and to retain screw members 114 captive within the valve body means 36. Washer-like members 120 are disposed in a recess in the cap member 110 about each of the screw members 114. A seal or O-ring 126 is disposed in a recess annularly about each of the washers 120. The ends of the sleeve members 86 each have an elongated flanged section 118 which engages a flange receiving recess in the end faces or sides 102 and 104 to prevent rotation of the sleeves 86. In addition, air may pass beside the flat side portions of the ends 118 and through the slots 122 in the outward ends of sleeve member 86 created by flat side portions of the ends 118. The cap members 112 have O-rings 128 disposed therein about cross grooves 130 which again abut the ends of the sleeve members 86 for allowing the passage of air about the elongated flat or flanged end portions 118. The alignment of the slots 99 with the passages 92 and 96 is maintained as the sleeves 86 are prevented from rotating by the flanged end portions 118 being disposed in the recesses in the end faces 102 and 104.

The pilot body means 42 has a bottom surface in flush engagement with the upper surface 58 of the block 100 and is secured thereto by Allen bolts 132. The pilot body means 42 has an upper sealing or electrical cover plate 134 secured thereto by screws 136. The pilot body means 42 includes a pilot shuttle valve assembly including a sleeve member 138 and a pilot shuttle valve 140.

The valve block 100 includes in the upper surface 58 thereof recess grooves 150 and 152, respectively. The recess groove 150 leads from a port 154 to a port 156. The port 154 communicates with the annular cavity 158 about the outward end of sleeve 86 in bore 82 so as to communicate air against the end of the spool valve member 88 adjacent the head 117 of the threaded member 114. The passage 156 at the other end of the groove 150 communicates with the opposite end of the spool valve 88 in the other spool bore 84. In a similar fashion the recessed groove 152 has a passage 162 at one end thereof communicating with the annular opening 164 at the outward end of the sleeve member 86 in the bore 84 and at the opposite end thereof a passage 166 communicating with the annular cavity 168 at the opposite end of the spool valve member 88 in the other bore 82. As alluded to hereinbefore, the passage of air about the end of the sleeve members 86 from the annular cavities 158, 160, 164 and 168 is by way of the slots 122 in the end of sleeve member 86 created by the flat side portions on flange 118 and the recesses 130 in the end cap member 112. The valve block 100 also includes passage 172 therein to convey fluid pressure from the inlet passage 92 to the pilot shuttle valve assembly 138, 140 and from the pilot shuttle valve assembly to opposite ends of the first and second spool valves 88.

The pilot valve 42 includes passages 178, 180, 182, 192 and 196 extending therethrough with the passage 180, 192 and 196 communicating with recess groove 181 in the lower face of pilot body 42. Recess groove 181 communicates with passage 172 in valve block 100. The passage 178 communicating with the passage or groove 150, the passage 182 communicating with the groove 152. In addition, passage 177 and 183 communicate with ports 176 and 184, respectively, in pilot valve means 42 (see FIG. 1). A gasket 186 having aligned holes is diposed between the upper surface 58 of the valve block 100 and the lower surface or plate of the pilot valve means 42 to prevent fluid leakage from the grooves and passages.

There is also included a pair of electrically operated solenoid valves 188 and 190. The electrically operated solenoid control valve 188 controls the flow of fluid under pressure from the passage 192 to the passage 194 which, in turn, communicates with the end of the spool member 140 to move the spool member 140 to the right as viewed in FIG. 2. In a similar fashion, the solenoid control valve 190 controls pilot fluid pressure through the passage 196 to the passage 198 and the opposite end of the pilot spool valve 104 to move it to the left as viewed in FIG. 2.

As will be appreciated, an operator in the field may purchase a control assembly including the valve body 36, a tube 46, and adapter 48, a pilot valve body 42, a pair of stud members 60 and a plug member 76 with a muffler 40 attached to the exhaust passage 98 of the valve body means 36. The valve body means 36 may be placed upon an air cylinder assembly 12 with either coupling bore 50 or 52 aligned with the cylinder port 28, depending upon the available distance between the valve body means 36 and the adapter 48. In other words, either coupling bore 50 or 52 will be aligned with the first cylinder port 28 depending upon the length of the cylinder which usually depends upon the length of the stroke of the piston rod 26. For a very, very short stroke resulting in a very, very short length of the tube 46, the second coupling port 52 will be aligned with the cylinder port 28. In any case, whichever port 50 or 52 is aligned with the cylinder port 28, a mounting stud member 60 is inserted through the coupling port to threadedly engage the cylinder port 28 to hold the valve body means 36 in position. A sealing plug 76 is inserted into the other coupling port 50 or 52 to prevent fluid leakage from the interior of the valve body means 36. The adapter 48 is placed in a proximate position over the other cylinder port 30 and the tube 46 is aligned therewith to measure the length of the tube 46 requried and the tube 46 is then cut to the appropriate length. As illustrated, there are line markings on the adapter body 48 to mark the length of tube 46 to be cut off. The cut tube 46 has one end inserted into the transfer port 54 so as to be in sealing engagement therewith by reason of seals disposed therein and the other end disposed in the adapter member 48 in sealing relationship therewith. The second stud member 60 is inserted through the coupling passage 74 in the adapter member 48 to clamp the adapter member 48 to the block 18 of the air cylinder about the second cylinder port 30 therein. The gasket 186 is then placed in engagement with the upper surface 58 of the valve body means 36 and the pilot valve body means 42 is disposed thereover and secured in position by the Allen fastener screws 132 which threadedly engage the block 100 of the valve body means 36. The electrical connector 44 is then connected to the pilot valve body means and the source of pressurized air is connected to the inlet passage 94 as a pressure hose 38 is threadedly connected thereto.

The passage 172 in the valve block 100 communicates with the high pressure air in the inlet passage 92 and which high pressure air is communicated to the recess groove 181 in lower face of pilot valve means 42 and to the passages 192 and 196 which, in turn, lead to the electrical control valves 188 and 190. Accordingly, upon actuation of the control valve 188, pilot fluid pressure from the passage 192 is allowed to pass through the passage 194 into the end of the pilot shuttle valve 140 to move it to the right as viewed in FIG. 2. The passage 172 in the valve block 100 is also a high-pressure source passage communicating with the passage 180 in the pilot block. Upon movement of the shuttle valve member 140 to the right, the pilot air pressure through passage 172 is communicated through passage 180 and about the central land of the shuttle and through the passage 182 and into the groove passage 152 to submit pressure to the upper end of the spool valve member 88 in the bore 82 as viewed in FIG. 3 and against the lower end of the spool valve member 88 adjacent the disc 117 of the adjustable screw member 114. At the same time, air may be exhausted through the opposite groove 150 from the opposite ends of the respective spool valve members 88 and through the passage 178 about the next outward land of the shuttle valve member 140 and out through the exhaust port 176 in the side of pilot valve means 42. In the event the system is operated in the opposite direction to move the piston 24 in the opposite direction, the solenoid 190 would allow fluid pressure through the passage 198 to mvoe the shuttle valve member 140 to the left, in which case pressure from the port 180 would pass through the passage 178 and into the groove 150 to the opposite end of the spool valve members 88 to move the spool valve member 88 in the bore 82 upward as viewed in FIG. 3 while moving the other spool valve member 88 downward in the bore 84 as viewed in FIG. 3 while the opposite ends of the spool valve members would be exhausted through the passages 152, 162, 166, 182 and out through the exhaust port 184 in the pilot valve means 42.

Upon movement of the spool valve 88 in the bore 82 downward against the disc stop 117 and movement of the other spool member 88 in the bore 84 upward against the plate 112, air pressure passes through the inlet passage 92 to the second spool valve member 88 in bore 84 and about the first land thereof and out the transfer passage 54 into the tube 46. At the same time, exhaust air comes up through the stud 60 in the coupling bore 50 and about the other land of the spool member 88 in bore 82 and out the exhaust passage 96. For operation in the opposite direction, the first spool member 88 in the first bore 82 would be shifted upwardly against the plate 112 whereby fluid pressure in the inlet passage 92 would pass about the land and into and through the member 60 in the first coupling bore 50 to the opposite side of the piston 24, moving the piston 24 to the right as viewed in FIG. 2. While at the same time the exhaust air would pass into the valve block body 100 from the tube 46 and about the spool valve 88 in the bore 84 and out through the exhaust passage 96. The linear adjustment of either of the adjusting threaded members 114 will determine the exhaust position of each of the spool valve members 88. In other words, the positon of the stop disc 117 determines the amount of movement of each spool valve member 88, thereby determining the size of the orifice through which the exhaust fluid may pass as it is flowing toward the exhaust passage or port 98. This, in turn, controls the rate at which the air may be exhausted from one side of the piston thereby controlling the rate at which the piston may move in response to pressure being applied to its opposite side.

Figure 10:
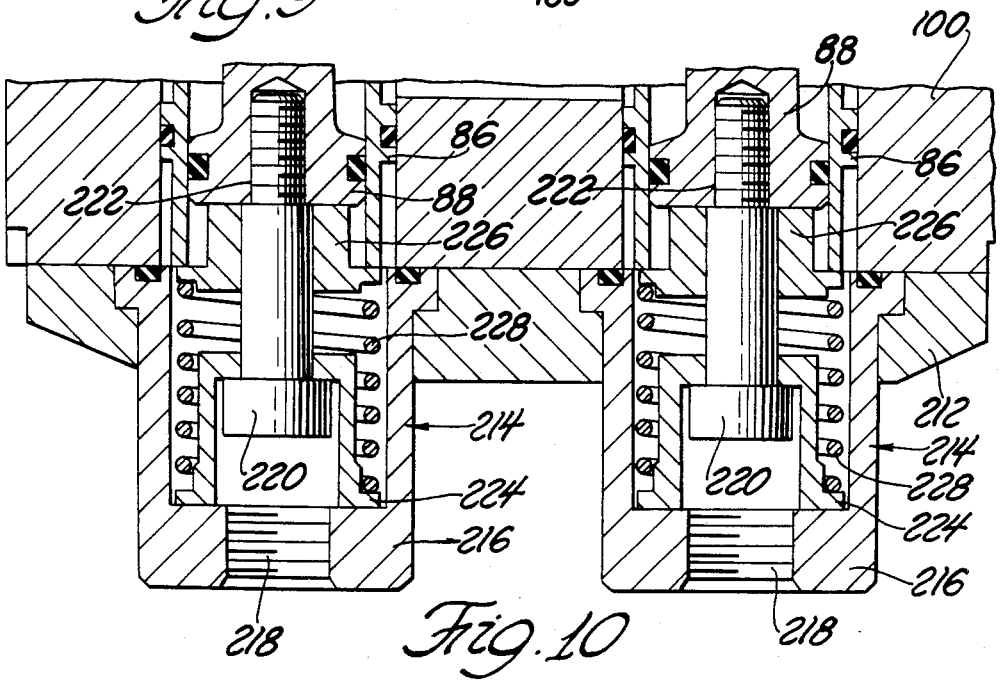
FIG. 10 is a fragmentary cross-sectional view showing an additional feature for controlling the position of the control.

In the configuration illustrated in FIG. 10, the cap 112 is replaced with a cap 212 for retaining biasing assemblies, generally indicated at 214, in position. Each biasing assembly 214 includes a cup-shaped housing 216 having a threaded bore plugged by a threaded plug 218. A threaded stud 220 threadedly engages the end of the associated spool 88 and has a head retained in a reaction cup 224. A reaction sleeve 226 is slidably supported on the stud 220 and engages or abuts the end of the spool 88 as well as having a flange for engaging the stationary end of the sleeve 86. A spring 228 is disposed between the reaction members 224 and 226 whereby when in the position illustrated, the spool 88 is maintained in a central or neutral position, stopping movement of the piston within the cylinder 12. In this configuration there are also included centering springs at each end of the shuttle valve member 140 to center the valve member 140 and discontinue pilot pressure supply to the valve 36.

As will be appreciated, the sleeve reaction member 226 moves to the right to compress spring 228 when the spool 88 moves to the right of center and when the spool moves to the left of center or neutral, the spring 228 is again compressed against the sleeve reaction member 226 as the stud 220 pulls the cup-shaped reaction member 224 to the left. As a result, these biasing means stop movement of the piston in the cylinder 12 upon discontinuance of pilot pressure.

As will be appreciated, the position and interconnection of the various fluid passages may be altered significantly to accomplish the same function while the remainder of the components remain unchanged.

Also, instead of the electrical solenoid valves, air pressure may be applied to the appropriate ports to control the pilot valve.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appeneded claims, wherein reference numerals are merely for convenience and are not to be in any way limiting, the invention may be practiced otherwise than as specifically described.

The embodiments of the invention in which an exclusive property or privilege is claimed are defined as follows:

1. A pneumatic control assembly (10) for a pneumatic cylinder (12) having a piston (24) movable therein between first and second positions and a rod (26) extending from the piston (24) exteriorly of the cylinder with the cylinder including first and second cylinder ports (28, 30) therein for communication of fluid to and from opposite sides of the piston (24) for moving the piston and rod between the first and second positions, said assembly (10) comprising; a valve body means (36) for directing fluid from a source (38) to the cylinder ports (28, 30) and for directing fluid from the cylinder ports (28, 30) to an exhaust environment (40), pilot body means (42) mountable on said valve body means (36) for piloting the operation of said valve body means in response to control signals (44), said valve body means (36) having a first coupling port (50) for communicating with the first cylinder port (28) and a transfer port (54) for communicating with the second cylinder port (30), transfer means (46, 48) for establishing fluid communication between said transfer port (54) in said valve body means (36) and the second cylinder port (30), said valve body means (36) having a first face (56) for engaging the pneumatic cylinder (12, 16) about the first cylinder port (28) therein and a second face (58) oppositely disposed and spaced from said first face (56) for flush engagement with said pilot body means (42), said first coupling port (50) extending through said valve body means (36) between said first (56) and second (58) faces thereof and by including mounting stud means (60) for extending through said first coupling port (50) and connecting to the first cylinder port (28) for providing the sole mounting force of said valve body means (36) to the pneumatic cylinder (12, 16) and for establishing sealed fluid communication between said valve body means (36) and the first cylinder port (28) while allowing said pilot body means (42) to be flush mounted against said second face (58) and over said mounting stud means (60), said mounting stud means (60) having a flange (62) at a first end thereof and threads (64) at the second end thereof for threaded engagement with said first cylinder port (28) to clamp said valve body means (36) between said flange (62) and said first cylinder port (16, 28) as said mounting stud means (60) is placed in tension between said flange (62) and said threads (64) thereof, and characterized by said stud means (60) being an integral stud member (60) having a shank portion (66) of lesser diameter than said threads (64) and positioned between said flange (62) and said threads (64) thereof and having a pocket (68) extending into said second end thereof interiorly of said threads (64) and conically extending passages (70) interconnecting said pocket (68) and the exterior of said shank portion (66).

2. An assembly as set forth in claim 1 further characterized by said integral stud member (60) including a sealing portion (72) of smaller diameter than said flange (62) and larger diameter than said shank portion (66) and extending between said flange (62) and said shank portion (66) for sealing engagement with the interior of said coupling port (50).

3. An assembly as set forth in claim 2 further characterized by said valve body means (36) having a recess in said second face (58) about said coupling port (50) for receiving said flange (62) of said stud member (60) so that said first end of said stud member (60) is prevented from interfering with the flush mounting of said pilot body means (42) against said second face (58) of said valve body means (36).

4. An assembly as set forth in claim 3 further characterized by said integral stud member (60) having a tool-receiving sockets (80) in said first end thereof for receiving a turning tool to threadedly tighten said stud member (60).

5. An assembly as set forth in any one of claims 3 or 4 further characterized by said valve body means (36) including a second coupling port (52) spaced from and idential to said first coupling port (50) and including a sealing plug means (76) for disposition in one of said first and second coupling ports (50, 52) as said stud means (60) is disposed in the other coupling port (50, 52), said sealing plug means (76) having a flange (78) at one end and a sealing surface extending therefrom for sealing engagement with one of said coupling ports (50, 52) to prevent fluid flow therethrough so that said valve body means (36) may be operatively connected to the cylinder at either of two longitudinal positions spaced apart by the distance between said first and second coupling ports (50, 52).

6. An assembly as set forth in any one of claims 1, 4, 5 or 7 further characterized by said transfer means including an adapter (48) and a tube (46) for extending between said transfer port (54) of said valve body means (36) and said adapter (48), said adapter (48) including a coupling passage (74) extending therethrough for communication with said tube (46), and a second integral stud member (60) identical to said first stud member (60) and extending through said coupling passage (74) and threadedly engaging the second cylinder port (30).

7. An assembly as set forth in claim 1 further characterized by including biasing means for instantaneously stopping movement of the piston (24) in the cylinder (12) in response to the discontinuance of the flow of control signal between said pilot body means and said valve body means.

8. A pneumatic control assembly (10) for a pneumatic cylinder (12) having a piston (24) movable therein between first and second positions and a rod (26) extending from the piston (24) exteriorly of the cylinder with the cylinder including first and second cylinder ports (28, 30) therein for communication of fluid to and from opposite sides of the piston (24) for moving the piston and rod between the first and second positions, said assembly (10) comprising; a valve body means (36) for directing fluid from a source (38) to the cylinder ports (28, 30) and for directing fluid from the cylinder ports (28, 30) to an exhaut environment (40), pilot body means (42) mountable on said valve body means (36) for piloting the operation of said valve body means in response to control signals (44), said valve body means (36) having a first coupling port (50) and a second coupling port (52) spaced from and identical to said first coupling port (50) for communicating with the first cylinder port (28) and a transfer port (54) for communicating with the second cylinder port (30), transfer means (46, 48) for establishing a fluid communication between said transfer port (54) in said valve body means (36) and the second cylinder port (30), said valve body means (36) having a first face (56) for engaging the pneumatic cylinder (12, 16) about the first cylinder port (28) therein and a second face (58) oppositely disposed and spaced from said first face (56) for flush engagement wtih said pilot body means (42), said assembly (10) characterized by first and second coupling ports (50, 52) extending through said valve body means (36) between said first (56) and second (58) faces thereof and by including mounting stud means (60) for extending through said first coupling port (50) and connecting to the first cylinder port (28) for providing the sole mounting force of said valve body means (36) to the pneumatic cylinder (12, 16) and for establishing sealed fluid communication between said valve body means (36) and the fluid cylinder port (28) while allowing said pilot body means (42) to be flush mounted against said second face (58) and over said mounting stud means (60) and by including a sealing plug means (76) for disposition in one of said first and second coupling ports (50, 52) as said stud means (60) is disposed in the other coupling port so that valve body means (36) may be operatively connected to the cylinder (12) at either of two longitudinal positions spaced apart by the distance between said first and second coupling ports (50, 52).

9. An assembly as set forth in claim 8 further characterized by said valve body means (36) including a first spool valve bore (82) extending transversely to said coupling ports (50, 52) and a first spool valve (88) disposed for reciprocal movement in said first spool valve bore (82), said first and second coupling ports (50, 52) extending through said valve body means (36) on opposite sides of said first spool valve bore (82) and in fluid communication therewith.

10. An assembly as set forth in claim 9 further characterized by said first spool valve bore (82) being cylindrical and said coupling ports (50, 52) being cylindrical and extending into and through said first spool bore (82) to establish said fluid communication.

11. An assembly as set forth in claim 10 further characterized by including sleeve means (86) disposed in said first spool bore (82) for slidably supporting said first shuttle spool valve (88), said sleeve means (86) being void to present an opening (90) between each of said coupling ports (50, 52) and said first spool bore (82) for spacing the circumferential extremity of said spool valve (88) from the circumference of said coupling ports (50, 52).

12. An assembly as set forth in claim 11 further characterized by said valve body means (36) including a second spool bore (84) parallel to said first spool bore (82) with second sleeve means (86) and a second spool valve (88) identical to said first sleeve means and spool valve (88) thereof with said transfer port (54) communicating with the void (90) of said second sleeve means (86).

13. An assembly as set forth in claim 12 further characterized by said valve body means (36) including an inlet passage (92) extending along a first axis from an entry port (94) through said first spool valve bore (82) to said second spool valve bore (84) and an exhaust passage (96) extending along a second axis from an exhaust port (98) through said first spool valve bore (82) to said second spool valve bore (84), said inlet (92) and exhaust (96) passages being parallel and positioned on opposite sides of said coupling ports (50, 52).

14. An assembly as set forth in claim 13 further characterized by said valve body means (36) including a rectangular block (100) presenting said first (56) and second (58) faces extending beteen first (102) and second (104) sides and first (106) and second (108) parallel ends, said spool valve bores (82, 84) extending through said block (100) between said first (102) and second (104) sides thereof, and first (110) and second (112) side caps in sealing engagement with said first (102) and second (104) sides of said block (100) to close the opposite ends of said spool valve bores (82, 84).

15. An assembly as set forth in claim 14 further characterized by said valve body means (36) including adjustable stop means (114, 116, 117) for limiting the amount of movement of at least one of said spool valves (88) to control the rate at which fluid is exhausted through said exhaust port (98) from at least one side of said piston (24).

16. An assembly as set forth in claim 15 further characterized by said pilot body means (42) including a pilot shuttle valve (138, 140) for directing pilot pressure to move said first and second spool valves (88), in said valve block (100) and said pilot body means (42) having communicating pilot passages (150, 152, 154, 156, 158, 160, 162, 164, 166, 168, 172, 176, 177, 178, 180, 182, 183, 184, 192, 194, 196, 198) therein to convey fluid pressure from said inlet passage (92) to said pilot shuttle valve (138, 140) and from said pilot shuttle valve (138, 140) to opposite ends of said first and second spool valves (88).

17. An assembly as set forth in claim 16 further characterized by said pilot body means (42) including at least one electrically operated control valve (188, 190) to control the flow of fluid in said passages (196, 198) to control said pilot shuttle valve (140).

18. An assembly as set forth in claim 17 further characterized by said mounting stud means (60) having a flange (62) at a first end thereof and threads (64) at the second end thereof for threaded engagement with one of said cylinder ports (28) to clamp said block (100) between said flange (62) and said cylinder port (16, 28) as said mounting stud means (60) is placed in tension between said flange (62) and said threads (64) thereof, said stud means (60) being an integral stud member (60) having a shank portion (66) of lesser diameter than said threads (64) and positioned between said flange (62) and said threads (64) and having a pocket (68) extending into said second end thereof interiorly of said threads (64) and conicially exending passages (70) interconnecting said pocket (68) and the exterior of said shank portion (66) and a sealing portion (72) of smaller diameter than said flange (62) and larger diameter than said shank portion (66) and extending between said flange (62) and said shank portion (66) for sealing engagement with the interior of one of said coupling ports (50, 52).

19. An assembly as set forth in claim 18 further characterized by said sealing plug means (76) having a flange (78) at one end and a sealing surface extending therefrom, said block (100) having an annular recess around each of said coupling ports (50, 52) in said first face (58) thereof for receiving said flange (62) of said stud member (60) and said flange (78) of said sealing plug (76).

20. An assembly as set forth in claim 19 further characterized by said transfer means including an adapter (48) and a tube (46) for extending between said transfer port (54) in said end (108) of said block (100) and said adapter (48), said adapter (48) including a coupling passage (74) extending therethrough for communication with said tube (46), and a second integral stud member (60) identical to said first stud member (60) and extending through said coupling passage (74) and threadedly engaging the second cylinder port (30).

* * * * *